US008168715B2

(12) United States Patent
Felix

(10) Patent No.: US 8,168,715 B2
(45) Date of Patent: May 1, 2012

(54) SLIDING COATING FOR WINTER SPORTS EQUIPMENT

(76) Inventor: Florian Felix, Garmisch-Partenkirchen (DE)

( * ) Notice: Subject to any disclaimer, the term of this patent is extended or adjusted under 35 U.S.C. 154(b) by 959 days.

(21) Appl. No.: 11/722,569

(22) PCT Filed: Dec. 21, 2005

(86) PCT No.: PCT/EP2005/013797

§ 371 (c)(1),
(2), (4) Date: Jul. 27, 2007

(87) PCT Pub. No.: WO2006/069706

PCT Pub. Date: Jul. 6, 2006

(65) Prior Publication Data

US 2008/0088099 A1 Apr. 17, 2008

(30) Foreign Application Priority Data

Dec. 23, 2004 (DE) ..... 10 2004 062 252
Jan. 27, 2005 (DE) ..... 10 2005 003 917

(51) Int. Cl.
*A61K 9/16* (2006.01)
*B60C 1/00* (2006.01)
*C08L 9/00* (2006.01)

(52) U.S. Cl. ..... 524/573; 524/543; 524/570

(58) Field of Classification Search ..... 524/300, 524/543, 570
See application file for complete search history.

(56) References Cited

U.S. PATENT DOCUMENTS 4,340,641 A 7/1982 Weiner
5,069,976 A 12/1991 Vuachet et al.
6,312,828 B1 11/2001 Akao
6,495,266 B1 * 12/2002 Migliorini ..... 428/461
7,119,155 B2 10/2006 Chow et al.
7,637,526 B2 12/2009 Felix et al.
2006/0151974 A1 * 7/2006 Felix et al. ..... 280/610

FOREIGN PATENT DOCUMENTS

JP 2004083887 A * 3/2004
WO WO 01/90230 A1 * 11/2001
WO WO2004/069352 8/2004

OTHER PUBLICATIONS

ExxonMobil pp. 7011L1 Technical Data Sheet.*
Data Sheet from Amco Plastic Materials, Inc.*
International Search Report for PCT/EP05/013797 (PCT/ISA/210).
Written Opinion of the International Searching Authority for PCT/EP05/013797 (PCT/ISA/237).

* cited by examiner

*Primary Examiner* — Mark Eashoo
*Assistant Examiner* — Angela C Scott
(74) *Attorney, Agent, or Firm* — Chaun A. Smith; Smith Patent Consulting, LLC

(57) ABSTRACT

According to the invention, a sliding coating for winter sports equipment is provided, which has a copolymer (I) and optionally a copolymer (II), wherein the sliding coating for a winter sports equipment comprises a copolymer (I) having 10% or more of structural building blocks derived from propylene monomers, based on the total number of the structural building blocks of the copolymer (I), and 1% or more of structural building blocks derived from another olefin, based on the total number of the structural building blocks of the copolymer (I), wherein the sliding coating does not have a copolymer, which has 50% or more of structural building blocks derived from ethylene monomers, based on the total number of the structural building blocks of the copolymer.

20 Claims, 4 Drawing Sheets

SLIDING COATING FOR WINTER SPORTS EQUIPMENT

PRIORITY

This application corresponds to the national phase of PCT Application No. PCT/E05/013797, filed Dec. 21, 2005, which, in turn, claims priority to German Patent Application No. 10 2004 062 252.3, filed Dec. 23, 2004 and 10 2005 003 917.0,filed Jan. 27, 2005, the contents of which are incorporated by reference herein in their entirety.

This application is related to co-pending U.S. patent application Ser. No. 10/544,544, filed Aug. 5, 2005, which corresponds to the national phase of PCT Application No. PCT/EP04/01078, filed Feb. 5, 2004, which, in turn, claims priority to German Patent Application No. 103 05 088.4, filed Feb. 7, 2005, the contents of which are incorporated by reference herein in their entirety.

FIELD OF THE INVENTION:

The invention relates to a sliding coating for winter sports equipment, especially for skis and snowboards. The sliding coating can be extruded in simple manner from a polymer material. Further, the invention relates to the winter sports equipment coated with the sliding coating.

BACKGROUND OF THE INVENTION:

The quality of winter sports equipment intended for sliding, for example on snow, in particular of skis and snowboards, is determined to a large extent by their sliding properties. Therefore, such winter sports equipment has as a rule a sliding coating which is intended to improve the sliding properties of the equipment on snow. Such a sliding coating substantially comprises a sheet which is adhesively bonded to the skis or snowboards with the aid of suitable adhesives. Such a sliding coating should be as hydrophobic as possible in order to ensure good sliding.

Due to its excellent sliding properties over a very broad spectrum of different types of snow, first, low-pressure polyethylene has been used as the material for the sliding coating (CH-A 601394), but has problems with the mechanical strength and resistance to wear. These problems are solved by using ultra high molecular weight polyethylene (PE-UHMW), however coatings of PE-UHMW cannot be produced by extrusion, but have to be produced in expensive manner e.g. by pressing, sintering and subsequent peeling (CH-A 601394).

There is a series of proposals for solving these problems and improving the sliding coatings, for example by using a crosslinked polyethylene-based polymer obtainable by extrusion (CH-A 601394) or by the inclusion of water-soluble compounds in the sliding coating (CH-A 601392). A more recent development proposes a sliding coating comprising polytetrafluoroethylene (AT-B 394 951), which, however, is not very advantageous simply for cost reasons and moreover does not sufficiently solve the problems of the sliding coatings for winter sports equipment. None of these proposals have become established in practice, and modern skis and snowboards usually have a sliding coating comprising PE-UHMW, which, owing to the high crystallinity, has the highest mechanical and chemical stability of the polyethylenes. Originally, this polyethylene has been used for manufacturing hip joints in the medical technology and is processed in powder form like thermosetting plastics in pressing and sintering processes using customary antistatic agents and lubricants.

It is also known to improve the sliding properties of sliding coatings by applying a surface structure which further improves the hydrophobic properties of the coating. However, there is a difficulty in that the effect of the surface structure does no longer occur if the structure is damaged, for example by slight mechanical influences in the course of use.

The slidability of skis is also improved by using special waxes, which usually is still required even on skis provided with a sliding coating. The reason for the use of waxes is on the one hand that they improve the hydrophobic properties of the sliding coating, and on the other hand that polyethylene, like virtually all plastics, does not change its surface hardness in a temperature range from about +20 to −20° C., whereas the sliding properties of the snow change as a function of temperature. Accordingly, waxes which, through a very wide range of additives, are designed for the various temperatures and types of snow are used, wherein a harder surface is desired at lower snow temperatures and a softer surface is desired at higher snow temperatures. Moreover, waxes which, in addition to adjustment of the surface hardness also form nanostructures which give rise to a lotus effect and hence ensure a completely unwettable surface are also obtainable. However, the use of waxes is complicated and a correct choice of a wax is difficult. In practice, it is necessary to stock a plurality of waxes in order to be able to react appropriately to different snow conditions.

WO 2004/069352 discloses sliding coatings for winter sports equipment, which are based on a mixture of two different copolymers, wherein one of the copolymers presents a copolymer of propylene and at least one further olefin, which is composed at least of 50% of structural building blocks derived from propylene monomers, based on the total number of the structural building blocks, and the other copolymer presents a copolymer of ethylene and at least one further olefin containing at least 50% of structural building blocks derived from ethylene, based on the total number of the structural building blocks. The sliding coatings or winter sports equipment, respectively, described in WO 2004/069352, which have these sliding coatings, have already excellent characteristics, especially with respect to their slidability. However, the expert is greatly restricted with respect to the copolymer system to be used in manufacture of corresponding winter sports equipment with sliding coatings.

Therefore, there is a need for sliding coatings for winter sports equipment and for winter sports equipment having such sliding coatings, in which the sliding coating is constructed of other polymers or polymer mixtures, respectively, and which have at least equally good, however, preferably even better mechanical properties and especially sliding properties than the winter sports equipment or sliding coatings known from WO 2004/069352, respectively.

SUMMARY OF THE INVENTION:

Surprisingly, according to the invention, it has been found that sliding coatings for winter sports equipment not having the mixture of copolymers described in WO 2004/069352, but having at least one copolymer (I) including 10% or more of structural building blocks derived from propylene monomers, based on the total number of the structural building blocks, and including 1% or more of structural building blocks derived from another olefin, also based on the total number of the structural building blocks in the copolymer, have excellent sliding properties, which are comparable or even superior to those of WO 2004/069352.

According to the invention, the copolymer (I) preferably has a bending strength in the range of 200 MPa-3000 MPa, preferably 500 MPa-3000 MPa. Preferred lower limits of the bending strength are at 700 MPa and 900 MPa, preferred upper limits of the bending strength of the copolymer (I) are at 2000 MPa and 1500 MPa. Therewith, particularly preferred ranges for the bending strength of the copolymer (I) of 700-2000 MPa, more preferred of 800-1500 MPa, for example ca. 900 MPa, ca. 1000 MPa or ca. 1100 MPa, result.

While it is surprisingly possible according to the invention to provide a sliding coating, which has only a single copolymer of propylene and another olefin, according to the invention, it is preferred that at least one further copolymer of propylene and another olefin is present, in the following referred to as copolymer (II). The copolymer (II) is also a copolymer based on propylene such that the sliding coating particularly preferred according to the invention has a mixture of two copolymers having both units derived from propylene.

Preferably, one of the two copolymers has a high bending strength, a high softening temperature and a high Shore D hardness, and the second copolymer based on propylene has a lower bending strength, a lower softening temperature and a lower Shore D hardness.

DETAILED DESCRIPTION OF THE INVENTION

According to the invention, therefore, a sliding coating for winter sports equipment is provided, which has at least one copolymer including 10% or more of structural building blocks derived from propylene monomers, and including at least 1% of structural building blocks derived from at least one further olefin, and referred to as copolymer (I). According to the invention, there is also provided a sliding coating for a winter sports equipment containing, besides the copolymer (I), at least one further copolymer (II). The invention also relates to winter sports equipment, especially skis, provided with such a sliding coating.

Unlike the sliding coating known from WO 2004/069352, the sliding coating according to the invention does not contain a copolymer having 50% or more of structural building blocks derived from ethylene monomers, based on the total number of the structural building blocks.

Copolymer (I) is a copolymer of propylene and at least one further olefin. Copolymer (I) preferably contains at least 10%, more preferred at least 30%, even more preferred at least 50% of structural building blocks derived from propylene monomers, based on the total number of the structural building blocks. However, these structural building blocks will not amount to more than 99% of the copolymer, based on the total number of the structural building blocks. Copolymer (I) preferably has 70 to 99%, more preferred 75 to 98%, especially 80 to 95%, for example about 90% of the structural building blocks coming from propylene monomers (each based on the total number of the structural building blocks).

Moreover, the copolymer (I) contains structural building blocks derived from at least one further olefin, especially from ethylene or a $C_4$-$C_{12}$ olefin. The proportion of the further olefin (the further olefins) makes up the remainder of the copolymer (I) (to 100% of the structural building blocks), such that the copolymer (I) preferably is a propylene/ethylene copolymer or a copolymer of propylene with one or more $C_4$-$C_{12}$ olefins or a copolymer of propylene, ethylene and one or more $C_4$-$C_{12}$ olefins. Preferably, also e.g. an ethylene/propylene diene terpolymer (EPDM) can be used, which can also contain dienes such as cyclooctadiene, dicyclopentadiene and/or hexadiene besides propylene and ethylene and a $C_4$-$C_{12}$ olefin, respectively. It is also possible that higher olefins or dienes are present in the copolymer (I).

If the copolymer (I) is employed together with a copolymer (II), it is preferred that the copolymer (I) has a higher Vicat softening temperature, a higher bending strength and a higher Shore D hardness than the copolymer (II).

According to the invention, the bending strength of the copolymer (I) is preferably by at least 50 MPa higher than the bending strength of the copolymer (II), more preferred by at least 100 MPa higher, more preferred by at least 500 MPa higher, e.g. by about 900 MPa or 1000 MPa or 1100 MPa higher than the bending strength of the copolymer (II).

According to the invention, the Vicat softening temperature VST/A/50 of the copolymer (I) is preferably higher than the Vicat softening temperature VST/A/50 of the copolymer (II) by at least 5° C., more preferred by at least 20° C., more preferred by at least 50° C., e.g. about 90° C. or 95° C.

According to the invention, the Shore D hardness of the copolymer (I) is higher than the Shore D hardness of the copolymer (II) preferably by at least 5 units, more preferred by at least 10 units, more preferred by at least 20 units, e.g. about 30 or 35 units.

The bending strength of the copolymer (I) is preferably in the range of 200 MPa-3000 MPa, preferably 500 MPa-3000 MPa. Preferred lower limit values for the bending strength are at 800 MPa and 1000 MPa. Preferred upper limit values for the bending strength of the copolymer (I) are at 2000 MPa and 1500 MPa. Preferred ranges of the bending strength of the copolymer (I) are therefore 800 MPa to 2000 MPa, more preferred 900 MPa to 1500 MPa, wherein particularly a value of ca. 1000 MPa is most preferred.

According to the invention, it is also preferred that the copolymer (I) has a Vicat softening temperature VST/A/50 in the range of 80° C. to 250° C. Preferred lower limit values for the Vicat softening temperature VST/A/50 are at 100° C. and 130° C. Preferred upper limit values for the Vicat softening temperature VST/A/50 are at 200° C. and 170° C. From this, the most preferred ranges for the Vicat softening temperature VST/A/50 of the copolymer (I) are from 100° C. to 200° C., more preferred from 130° C. to 170° C. A Vicat softening temperature VST/A/50 of ca. 150° C. is most preferred.

According to the invention, it is also preferred that the Shore D hardness of the copolymer (I) is in the range of 50 to 90. Preferred lower limits for the Shore D hardness are at 55 and 60, preferred upper limit values for the Shore D hardness are at 80 and 70. Therewith, the most preferred ranges for the Shore D hardness of the copolymer (I) are from 55 to 80, more preferred of 60 to 70. A copolymer (I) having a Shore D hardness of ca. 65 is most preferred.

The copolymers (I) most preferred according to the invention are commercially available. If the copolymer (I) is not employed in mixture with a further copolymer having units derived from propylene monomers, for example, commercial products such as Adstif EA648P and Adflex X500F of the company Basell can be employed. If the copolymer (I) is employed in mixture with a copolymer (II), as defined below, according to the invention, for example, the product Hostalen PP EPD60R (bending strength ISO 178: 1050 MPa; Vicat softening temperature ISO 306 A/50: 151° C.; Shore D ISO 868: 64) of the company Basell is preferred.

If the copolymer (I) is employed in mixture with copolymer (II), the copolymer (I) makes up preferably 1 to 99% by weight, more preferred 95 to 50% by weight, especially 95 to 70% by weight, e.g. about 90% by weight of the mixture of the copolymers (I) and (II).

The copolymer (II) is also a copolymer of propylene and at least one further olefin, however which preferably exhibits a lower bending strength, softening temperature and Shore D hardness than the copolymer (I). With respect to the composition of the copolymer (II), reference can be made to the explanations to copolymer (I), however, in the embodiment particularly preferred according to the invention, in which the sliding coating for winter sports equipment has a mixture of copolymer (I) and copolymer (II), the structure of the copolymer (II) and/or the content of comonomers in the copolymer (II) is particularly preferred different from that in the copolymer (I), whereby different parameters with respect to the bending strength, softening temperature and Shore D hardness are obtained. Therein, the copolymer (II) is also a copolymer of propylene and at least one further olefin, especially of ethylene and/or a $C_4$-$C_{12}$ olefin. The copolymer (II) is preferably a copolymer of propylene and ethylene or a copolymer of propylene and one or more $C_4$-$C_{12}$ olefins or a copolymer of propylene, ethylene and one or more $C_4$-$C_{12}$ olefins. Also the copolymer (II) can contain dienes such as cycloacetadiene, dicycloapentadiene and/or hexadiene. Also higher olefins or dienes can be present in the copolymer (II).

According to the invention, it is preferred that the bending strength of the copolymer (II) is in the range of 1 MPa to 500 MPa. Preferred lower limits for the bending strength of the copolymer (II) are 10 MPa and 20 MPa, preferred upper limits for the bending strength of the copolymer (II) are 200 MPa and 100 MPa. Particularly preferred, the bending strength of the copolymer (II) is therefore in the range of 10 MPa to 200 MPa, more preferred 20 MPa to 100 MPa. A copolymer (II) having a bending strength of about 30 MPa is particularly preferred.

According to the invention, it is also preferred that the Vicat softening temperature VST/A/50 of the copolymer (II) is in the range of 1° C. to 80° C. Preferred lower limits of the Vicat softening temperature VST/A/50 of the copolymer (II) are 30° C. and 40° C., preferred upper limits are 70° C. and 60° C. Particularly preferred ranges of the Vicat softening temperature VST/A/50 for the copolymer (II) are thus 30 to 70° C. and 40 to 60° C. Especially, a copolymer (II) having a Vicat softening temperature of about 55° C. is preferred.

According to the invention, it is also preferred that the Shore D hardness of the copolymer (II) is in the range of 1 to 50. Preferred lower limits of the Shore D hardness are 20 and 25, preferred upper limits of the Shore D hardness are 35 and 40. Particularly preferred ranges for the Shore D hardness of the copolymer (II) are therefore from 20 to 40 and from 25 to 35. Especially, a copolymer is preferred, which has a Shore D hardness of about 30.

The preferred copolymers (II) employable according to the invention are commercially available, for example Adflex Q 100 F (bending strength ISO 178: 80 MPa; Vicat softening temperature ISO 306 A/50: 55° C.; Shore D ISO 868: 30) of the company Basell.

The Copolymer (II) makes up preferably 1 to 90% by weight, more preferred 5 to 50% by weight, more preferred 5 to 30% by weight, for example about 10% by weight of the mixture of the copolymers (I) and (II).

Both the copolymer (I) and the copolymer (II) can be "random" copolymers. However, preferably, at least the copolymer (I) is a block copolymer, in which the comonomers have been polymerized onto a polypropylene block. The copolymer (II) can be e.g. a copolymer, in which blocks of polypropylene have been linked to each other through the comonomers. The properties of the copolymer can then be varied e.g. via the block length of the polypropylene.

The term "copolymers", as it is used in the scope of this description, includes not only copolymers of two monomer units, but also copolymers constructed of more than two different monomer units, especially of three different monomer units or of four different monomer units. The term "copolymers", as is used here, thus includes especially also terpolymers. The term "olefin", as is used here, includes compounds with one or more double bonds, preferably with one or two double bonds (dienes) preferably containing not more than 16, more preferred not more than 10 carbon atoms, and which may be branched or linear.

Preferably, the mixture of the copolymer (I) and the copolymer (II) has a bending strength in the range of 200 MPa-3000 MPa, preferably 500 MPa-3000 MPa. Preferred lower limits of the bending strength are at 700 MPa and 900 MPa, preferred upper limits of the bending strength of the polymer mixture are at 2000 MPa and 1500 MPa. Therewith, particularly preferred ranges for the bending strength of the mixture of copolymer (I) and copolymer (II) are from 700 to 2000 MPa, more preferred from 800 to 1500 MPa. It is particularly preferred that the mixture has a bending strength of about 1000 MPa.

The use of a mixture of copolymer (I) and copolymer (II) allows "fine tuning" of the properties of the sliding coating, which can thereby particularly well be adjusted to certain requirements, which is not possible using only the copolymer (I).

The Vicat softening temperature VST/A/50 of the mixture of the two copolymers is preferably in the range of 80° C. to 250° C. Preferred lower limits for the Vicat softening temperature VST/A/50 are 100° C. and 110° C., preferred upper limits are at 200° C. and 170° C. Particularly preferred ranges of the Vicat softening temperature VST/A/50 of the mixture of the two copolymers are therefore 100 to 200° C., more preferred 110 to 150° C., e.g. 130° C.

Preferably, the Shore D hardness of the mixture of the two copolymers is in the range of 50 to 90. Preferred lower limits for the Shore D hardness are at 55 and 60, preferred upper limits are at 80 and 70. Therewith, particularly preferred ranges for the shore D hardness of the mixture of the two copolymers are from 55 to 80 and 60 to 70. A copolymer mixture having a Shore D hardness of ca. 67 is particularly preferred.

The copolymers employed according to the invention are commercially available or can be produced by one skilled in the art due to few routine experiments. As a whole, it is true that the bending strength, the Shore D hardness and the Vicat softening temperature can be reduced especially in copolymers having a polypropylene block by reducing the content of propylene in the copolymer. Therefore, in the embodiment of the invention, in which a mixture of copolymer (I) and copolymer (II) is employed, the copolymers (I) usually have a higher content of propylene units than the copolymers (II). However, how copolymers with the corresponding parameters can be produced, belongs to the general special knowledge of a polymer chemist.

However, corresponding copolymers are also commercially available from the companies Basell and Exxon as well as Borealis, for example.

According to the invention, by a softening temperature, always a Vicat softening temperature is understood, which has been determined according to the specification ISO 306: 2004. According to this ISO specification, there are four methods for determining the Vicat softening temperature of thermoplastic materials, namely a method A50, in which a force of 10 N and a heating rate of 50° C. per hour are used, a method B50, in which a force of 50 N and heating rate of 50° C. per hour are used, a method A120, in which a force of 10 N and a heating rate of 120° C. per hour are used, and a method B120, in which a force of 50 N and a heating rate of 120° C. are used. According to the invention, all of the Vicat softening temperatures have been determined according to the method A50 that is using a force of 10 N and a heating rate of 50° C. per hour. For details of the method, reference is made to the corresponding ISO standard.

According to the invention, the bending strengths have been determined according to ISO 178:2001, that is, the bending strength of a 3-point bending load at 23° C. For details of the determination, reference is made to the corresponding ISO standard.

According to the invention, the Shore hardness is determined according to the ISO standard 868:2003: The ISO standard 868:2003 defines two methods for determining the Shore hardness, type A, provided for softer materials, and type B, provided for harder materials. Principally, the Shore hardness is measured with a probing tip. The measure for the hardness is the penetration depth, wherein the force is applied by a calibrated spring. It is measured at room temperature (23° C.) for 3 seconds. According to the invention, for harder materials, it is measured according to the D method (or the D scale, respectively) using a cone (needle with a rounded tip, R=0.1 mm). For details of the method, reference is made to the corresponding ISO standard.

Advantageously, the copolymer or the copolymer mixture, respectively, for producing the sliding coating according to the invention, contains one or more lubricants known per se and suitable for polypropylenes. If lubricants are present, they are preferably present in an amount from 0.1 to 30% by weight or from 5 to 30% by weight, more preferred in an amount from 0.5 to 10% by weight or from 1 to 10% by weight, e.g. in an amount of about 1% by weight or of about 3% by weight based on the total weight of the copolymer (I) or of the mixture of copolymer (I) and copolymer (II), if applicable. Particularly preferred, a lubricant is used, which is a usual hydrophobic lubricant e.g. based on high-temperature stable primary or secondary fatty acids, such as primary fatty acid amines, or carboxylic acid esters. Also, a mixture of a lubricant based on high-temperature stable primary fatty acids with one or more carboxylic acid esters is particularly preferred. Usual commercial products are the products Hecoslip 103 PO and Hecoslip 114 PP of the Hecoplast GmbH (Iserlohn, Germany). Particularly preferred, a mixture of a high-temperature stable primary fatty acid and a carboxylic acid ester is employed in a ratio of about 1:2.

Further, the sliding coatings according to the invention can contain usual antistatics, especially the antistatic additives known for polypropylene such as carboxylic acid esters. Such antistatics, if present, are preferably present in an amount from 0.1 to 30% by weight or 5 to 30% by weight, more preferred from 0.5 to 10% by weight, for example in an amount of about 1% by weight, based on the total weight of the copolymer I or the mixture of copolymer (I) and copolymer (II), if applicable.

Further, the sliding coatings according to the invention can include usual nucleation agents, especially nucleation agents usual for polypropylene. Nucleation agents are nucleus formation means such as sodium benzoate, which have been presented in the 60's for the first time and which are available e.g. from the company Henkel KGaA (Düsseldorf, Germany) or the Hecoplast GmbH (Iserlohn, Germany). Organic nucleation agents such as nucleation agents based on sugar, such as sorbitol acetate, are preferred according to the invention. A preferred commercial product is the product Heconuk 484PP of the company Hecoplast. Such nucleation agents, if present, are preferably present in an amount from 0.1 to 30% by weight, more preferred from 0.5 to 10% by weight, for example in an amount of about 2% by weight, based on the weight of the copolymer (I).

In a preferred embodiment of the invention, the sliding coatings according to the invention contain both at least one nucleation agent as defined above and at least one lubricant as defined above, each in the above indicated preferred amounts. It is also preferred that the lubricant is partially or completely bound to the nucleation agent. If a nucleation agent is present, preferably, primary fatty acids and/or secondary fatty acids are employed as the lubricant, preferably in a proportion of 1 to 90% by weight based on the total weight of the nucleation agent, more preferred in a proportion of 1 to 10% by weight based on the total weight of the nucleation agent, especially in a proportion of about 7% by weight based on the total weight of the nucleation agent.

In the preferred embodiment, in which the sliding coating contains both a nucleation agent and a lubricant, which is optionally or (preferably) totally bound to the nucleation agent, particularly preferred, a mixture of a high-temperature stable primary fatty acid and a carboxylic acid ester in a proportion of about 1:10 is employed as the lubricant.

Also further usual additives can be present in the sliding coating according to the invention, such as additives for improving the hydrophobic and antistatic properties or the weather resistance and scratch resistance, wherein especially silicon compounds, particularly inorganic silicon compounds such as silicon dioxide, maleic anhydride, carbon black and fluorine or fluorinated hydrocarbons, respectively, can be mentioned. If applicable, pigments such as $TiO_2$ are also present. The most suitable amounts of such additives can easily be determined by routine experiments, and each additive, which is present, is preferably present in an amount from 0.05 to 3% by weight, more preferred from 0.1 to 2% by weight, each based on the weight of the copolymer (I) or the mixture of copolymer (I) and copolymer (II), respectively. Sliding coatings according to the invention are particularly preferred, which contain a lubricant, a nucleation agent, a silicon compound and maleic anhydride.

Particularly preferred, the silicon compound is hydrophobic, pyrogenic silicic acid, which is present in the form of nano particles. The nano particles preferably have a surface according to BET (DIN 66131) in the range of 80 to 300 $m^2/g$, preferably in the range of 110 to 260 $m^2/g$, e.g. 160 $m^2/g \pm 25$ $m^2/g$. Such products are for example available from the company Degussa under the designation Aerosil. According to the invention, the product Aerosil R8200 is particularly preferred.

The maleic anhydride serves as a hydrophobic agent, but also as an adhesive agent or coupling agent, respectively, for the nano particles. Also the maleic anhydride is commercially available, in the examples, the product Exxelor from the company Exxon Mobil has been employed, however, it is understood that other maleic anhydrides can also be used.

Further, usual light protection agents can be added to the sliding coating, especially light protection systems for polyolefins and particularly preferred light protection systems for polypropylene. Such light protection systems are known in the prior art. For example, they are systems based on sterically hindered amines, and the HALS light protection concentrate Hecostab 372 from the company Hecoplast can be mentioned as a special product.

If the ski is provided for high-performance applications, for example race skiing, in usual manner, special impregnations can be applied in usual manner, which preferably can bind to polypropylene and which immediately improve the hydrophobic and antistatic properties and which additionally enhance the surface hardness. Here, a mixture of fluorinated isopropanol and water can be mentioned.

Surprisingly, it has been found that the copolymer (I) can optionally be processed to a film by a simple extrusion method in mixture with copolymer (II) and optionally further additives, as defined above, which is suitable in particularly excellent manner as a sliding coating for winter sports equipment and especially for skis and snowboards. The coating changes its hardness in a temperature range of +20 to −20° C. such that it becomes harder with decreasing temperature, an effect that heretofore could only be achieved using waxes.

Moreover, the sliding coatings according to the invention exhibit an excellent notch impact strength and a strength comparable to that of sliding coatings based on polyethylene, at least as far as the requirements made to winter sports equipment are concerned.

The copolymers or copolymer mixtures for producing the sliding coating according to the invention, respectively, can be processed in usual manner. A particular advantage of the copolymers or copolymer mixtures, respectively, is in that they can be formed to sliding coatings by usual extrusion methods, for example by flat sheet extrusion methods. The pressing-sintering methods required with other polymers such as PE-UHMW are not necessary according to the invention. Therefore, according to the invention, the processing can be effected in usual single or double-screw extruders, especially in three-zone screw extruders with mixing portion, preferably in combing three-zone double-screw extruders with mixing portion. The extrusion tools are known to one skilled in the art, and here usual beam or coat hanger tools (dies) can be mentioned as examples. For calibration, usual calendar or smoothing rolling equipments can be used, particularly so-called chill-roll equipments.

According to the invention, it is also advantageous to apply a surface structure onto the sliding coating, which induces a wettability as low as possible. Surprisingly, it has been found that in the sliding coating according to the invention, on which a surface structure has been applied in usual manner, the wettability is particularly greatly reduced, such that a lotus effect occurs even without use of a wax.

Therein, another advantage according to the invention results from the fact that the propylene copolymer has a so-called "memory effect", which occurs if the surface structure is applied still below the molecular freezing limit. By the memory effect, the surface structure restores itself, if it has been slightly damaged by mechanical effects.

The surface structure is attached to the sliding coating in the same manner as it is known from skis, for example by using structured smoothing rollers. As mentioned above, it is preferred that the surface structure is applied onto the sliding coating before the molecular freezing point.

The sliding coating according to the invention usually has a thickness of 0.1 to 10 mm, preferably of 0.5 to 5 mm, especially of about 1 mm.

The sliding coating according to the invention can be attached to winter sports equipment, especially skis and snowboards, in usual manner. Herein, it is particularly preferred to apply the sliding coating onto the winter sports equipment with suitable adhesives such as the usual hot melt adhesives, or with a melt-adhering plastic such as a polyamide resin or an ethylene vinyl acetate copolymer or the modifications thereof. However, the sliding coating can also be connected to the equipment in another known manner. Before application, the winter sports equipment, especially the ski or the snowboard, can be subjected to a usual pretreatment such as brushing, sand blasting, degreasing, etching or pickling, and the sliding coating can be subjected to a usual surface treatment such as a corona treatment, flame treatment, primer treatment or ozone shower.

The following examples explain the invention.

EXAMPLE 1

Mixture: 90 kg Hostalen PP EPD60R, 10 kg Adflex Q 100F, 2 kg Heconuk 484PP, 2 kg Hecostab 372, 1 kg Hecoslip 103PO, 1 kg Exxelor maleic anhydride, 2 kg Aerosil R8200.

EXAMPLE 2

Mixture: 100 kg Adstif EA 648P, 2 kg Heconuk 484PP, 2 kg Hecostab 372, 1 kg Hecoslip 103PO, 1 kg Exxelor maleic anhydride, 2 kg Aerosil R8200.

The above indicated ingredients of the mixtures each have been mixed together for 30 minutes in a usual mixer. Subsequently, the mixtures each have been extruded to a 1 mm thick film in a flat sheet extrusion equipment having a three-zone single-screw extruder of the mark Colin with a chill-roll equipment with smoothing rolls. The surface treatment was effected with a usual ski stone grinding equipment of the mark Montana.

TEST EXAMPLE

From the products of examples 1 and 2, small sample plates (5 cm×5 cm) have been ground with abrasive paper having a grain size of about 8 μm and an emery paste with a particle size of about 100 nm, whereby the surface of the sliding coating was given a lotus effect. After washing out the debris an extremely slidable film surface has been obtained, on which water drops spherically rolled off.

Upon cooling the film, a high increase of the surface hardness, upon heating, a decrease of the surface hardness manifested.

The films were applied in known manner to a ski and to a snowboard using a usual adhesive. Thereupon, these winter sports equipment were test run with wet snow, cold and dry snow as well as artificial snow in order to perform a qualitative sliding test in practice. Skis and snowboards, which were equipped with the highest-grade commercially available PE-UHMW sinter coatings of the mark P-TEX served as a reference. The reference coatings were provided with the same grinding finish on the same above-mentioned stone grinding equipment as the ones to be tested, and professionally prepared with suitable waxes for the respective snow temperature as usual for the racing use.

In comparison, the winter sports equipment with the new coatings according to the invention did not seem to be inferior to the conventional ones in any manner. In contrast, especially with wet snow, the products according to the invention seemed to be slightly superior to the sinter coatings.

In the following, the above described coating of example 1 according to the invention is referred to as FX-SmartBase NANO, that of example 2 as FX-SmartBase NANO B.

Figure 1:
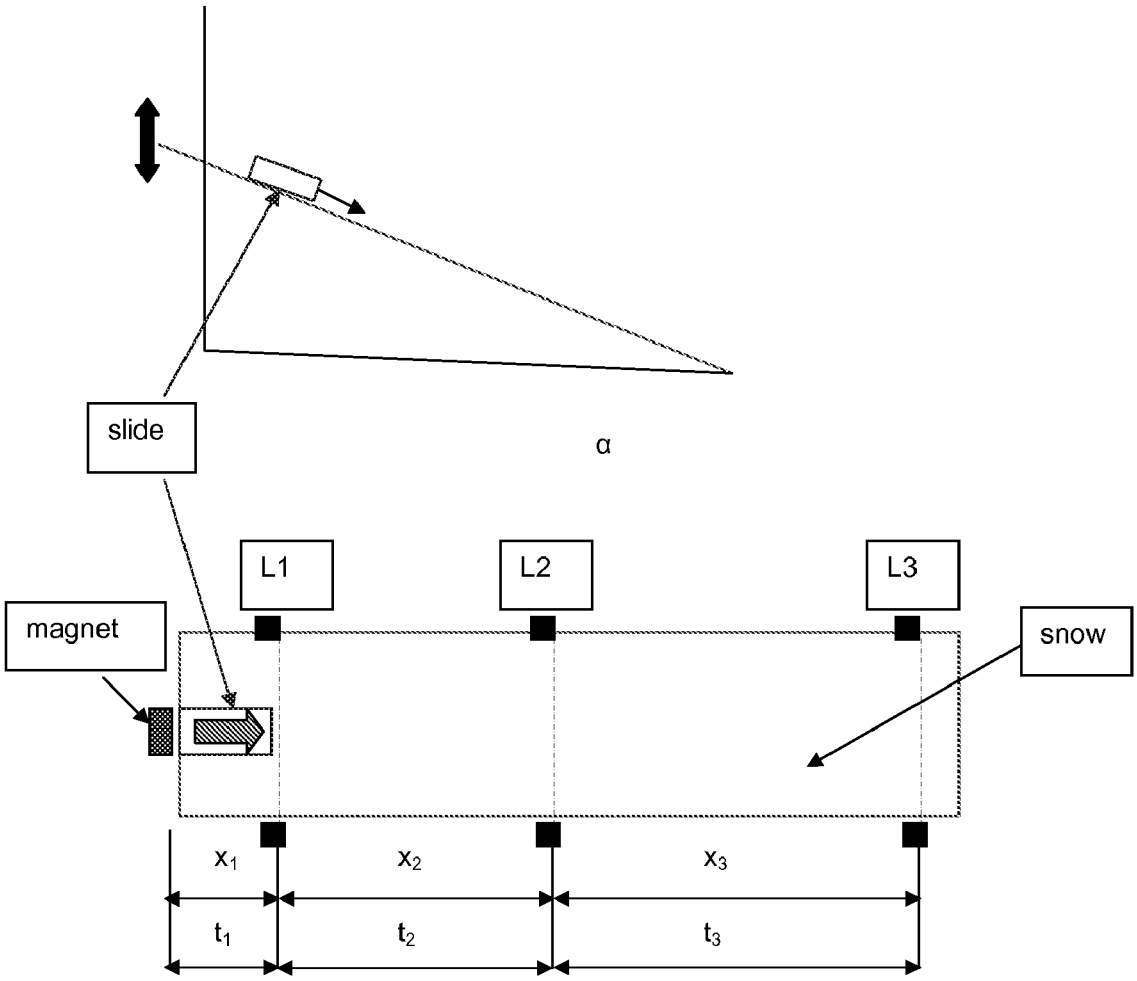
FIG. 1 depicts the experimental setup used to compare the sliding properties of the FX-SmartBase NANO and FX-SmartBase NANO B coatings of the invention with waxed reference coatings (i.e., P-Tex+EC1)

For quantitative analysis, the following experimental setup was used, which allows an objective comparison of the sliding properties of the new coatings FX-SmartBase NANO and NANO B according to the invention with waxed reference coatings. The setup is shown in FIG. 1.

On an inclined plane with defined angle of inclination α of snow, a slider with the coating to be tested as the sliding surface is to slide down. Initially, the slider is retained by a magnet. If it triggers, then the time measurement begins and the slider herein passes three light barriers (L1, L2, L3).

Herein, on the first distance x1 (5.5 cm) from the magnet to L1, the first time t1 is taken. Thereupon, on the second distance x2 (50 cm) to the light barrier L2, the second time t2, and finally on the third distance x3 (50 cm) to the light barrier L3, the third time t3 is taken.

For control, a CPU of the company Jetter model nano b was used. The magnet was an electrical magnet of the company IBS with 24 V input voltage. As the light barriers, IR light barriers of the company IDEC with a range of 80 cm and a response time of 1 ms were chosen.

Coating samples having an area of 80 $cm^2$ of FX-SmartBase NANO and NANO B were compared at warm and cold snow with the reference coating P-Tex, which was prepared with the suitable wax based on the respective snow conditions.

Figure 2:
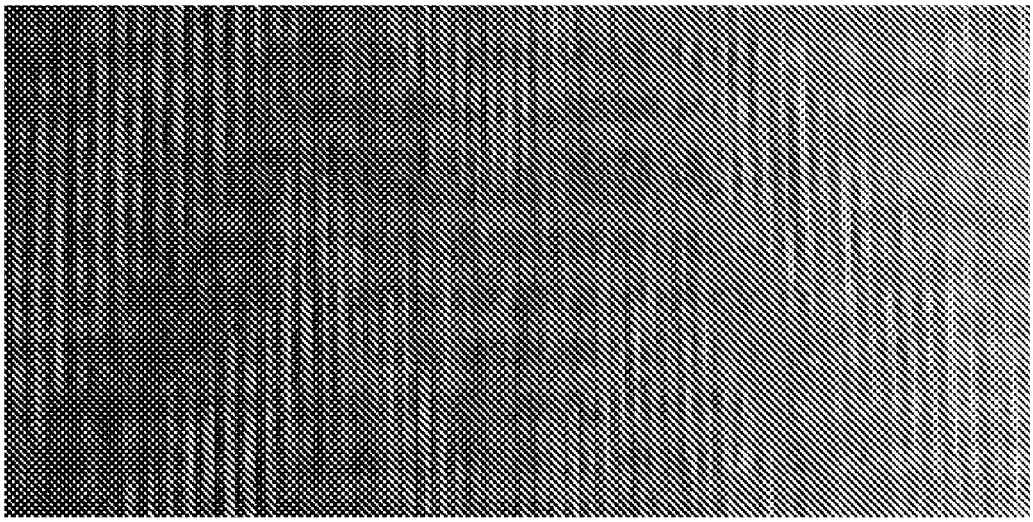
FIG. 2 is a photograph depicting the structure of the coating samples tested.

All of the samples were provided with the same all-round structure, as is shown in FIG. 2, on a stone grinding machine of the company Montana according to the crystal glide finish method.

For the warm and wet snow tests, respectively, the wax Eclipse EC1 High Fluor +8° . . . −3° C. of the company Star SkiWax was used at a snow temperature of −2° C. and an air temperature of +2° C.

For the cold and dry snow tests, the wax Eclipse EC2 High Fluor 0° . . . −10° C. of the company Star SkiWax was used at a snow temperature of −6° C. and an air temperature of −4° C.

The wax was applied onto the P-Tex samples with a wax flatiron of the company TOKO. Thereupon, the samples were cooled at room temperature for two hours. The wax was peeled off with a peel-off blade of the company TOKO. Thereafter, the grinding structure was brushed out again with a structure brush of the company TOKO.

The FX-SmartBase NANO coating and the NANO B were not waxed.

The coatings were mounted on the sliders with double-sided adhesive tape and screw connections.

Thereupon, the slider was weighted with the mounted coating. A high-accuracy scale accurate to gram of the company Soehnle model 8048 cyber served as a scale.

Then, the tub, on the bottom of which artificial grass rested for better adhesion of the snow, was filled with snow and smoothed with a ruler such that a plane surface arose. Before each run, the experimental runway was newly filled with snow and smoothed.

Thereafter, the slider was set on the guide and guided on the magnets without ground contact.

The magnet was triggered and the measurements at the light barriers were effected.

Ten runs were performed per coating, and the resulting times of all of the ten runs were averaged.

Thereupon, the averaged times were compared with each other and the average velocities were calculated.

Results:

All of the sliders with mounted coating had the same weight, which was 339 g. The angle of inclination α was 15° in all of the experiments, which corresponds to a slope of 25.88%.

1. Series of Experiments Warm and Wet Snow (Snow Temperature: −2° C., Air Temperature: +2° C.)

Figure 3:
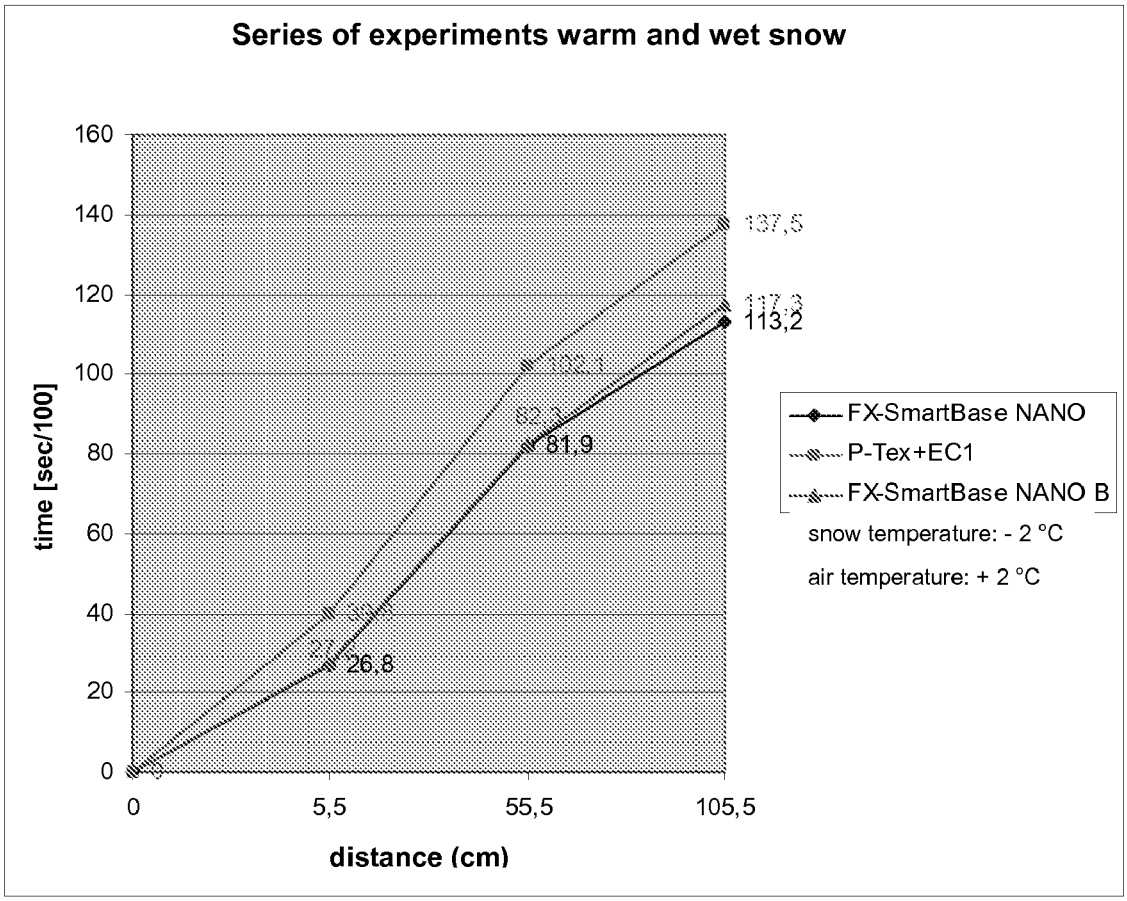
FIG. 3 depicts the results of the comparative experiments (EX-SmartBase NANO vs. FX-SmartBase NANO B vs. P-Tex+EC1) with warm and wet snow described below (i.e., snow temperature: −2° C, air temperature: +2° C).

| Measurement | t [sec/100] | x [cm] |
|---|---|---|
| FX-SmartBase NANO | | |
| average L1 | 26.8 | 5.5 |
| average L2 | 81.9 | 55.5 |
| average L3 | 113.2 | 105.5 |
| FX-SmartBase NANO B | | |
| average L1 | 27.2 | 5.5 |
| average L2 | 82.3 | 55.5 |
| average L3 | 117.3 | 105.5 |
| P - Tex + EC1 | | |
| average L1 | 39.8 | 5.5 |
| average L2 | 102.1 | 55.5 |
| average L3 | 137.5 | 105.5 |

velocity: v = x/t
with:
v: average velocity
x: distance
t: time required for x
there results:
FX-SmartBase NANO: v = 0.932 m/s
FX-SmartBase NANO B: v = 0.899 m/s
P-Tex + EC1: v = 0.767 m/s Thus, on a starting distance of 105.5 cm, the FX-SmartBase NANO is faster by 17.7% and the FX-SmartBase NANO B is faster by 14.7% with the tested wet snow. The result is shown in FIG. 3.

2. Series of Experiments Cold and Dry Snow (Snow Temperature: −6° C., Air Temperature: −4° C.)

Figure 4:
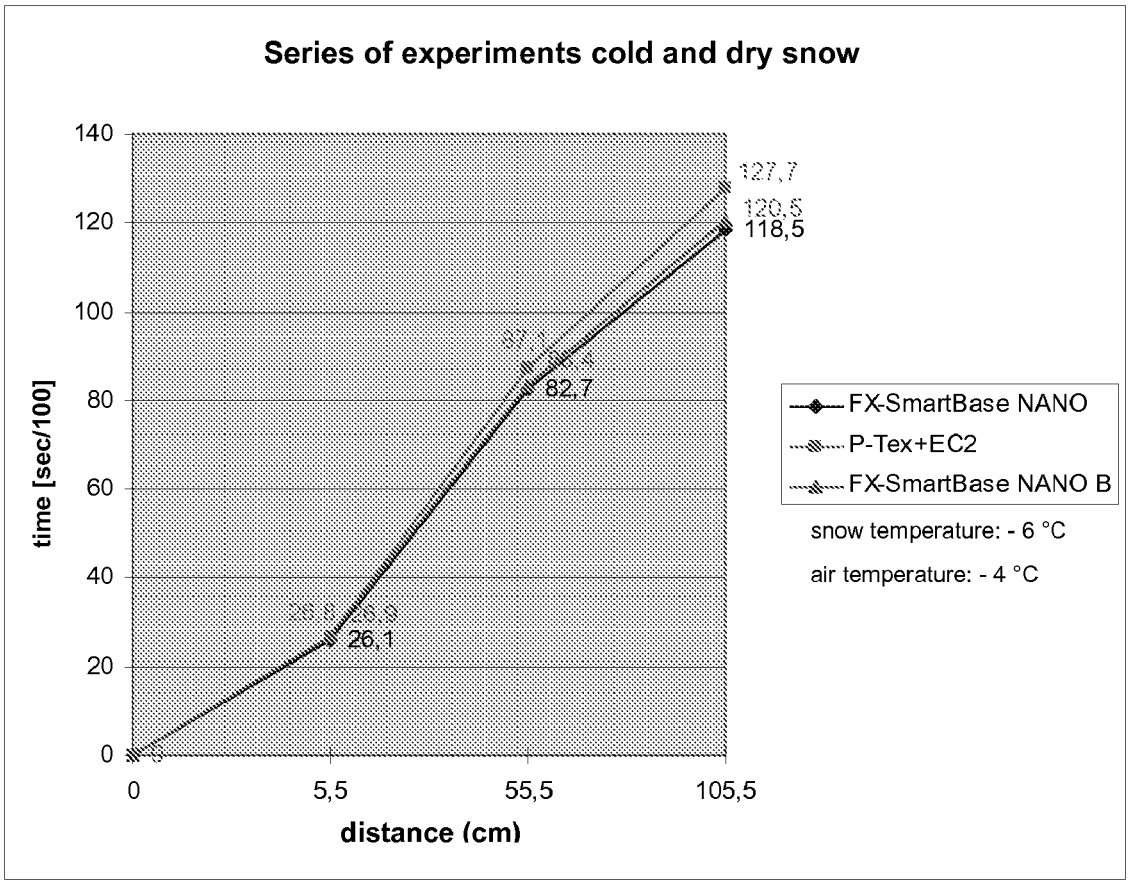
FIG. 4 depicts the results of the comparative experiments (FX-SmartBase NANO vs. FX-SmartBase NANO B vs. P-Tex+EC1) with cold and dry snow described below (i.e., snow temperature: −6° C, air temperature: −4° C).

| Measurement | t [sec/100] | x [cm] |
|---|---|---|
| FX-SmartBase NANO | | |
| average L1 | 26.1 | 5.5 |
| average L2 | 82.7 | 55.5 |
| average L3 | 118.5 | 105.5 |
| FX-SmartBase NANO B | | |
| average L1 | 26.9 | 5.5 |
| average L2 | 83.4 | 55.5 |
| average L3 | 120.5 | 105.5 |
| P - Tex + EC2 | | |
| average L1 | 26.8 | 5.5 |
| average L2 | 87.1 | 55.5 |
| average L3 | 127.7 | 105.5 |

velocity: v = x/t
with:
v: average velocity
x: distance
t: time required for x
there results:
FX-SmartBase NANO: v = 0.890 m/s
FX-SmartBase NANO B: v = 0.875 m/s
P-Tex + EC2: v = 0.826 m/s Thus, on a starting distance of 105.5 cm, the FX-SmartBase NANO is faster by 7.19% and the FX-SmartBase NANO B is faster by 5.6% with the tested cold snow. The result is illustrated in FIG. 4.

The invention claimed is:

1. An article of winter sports equipment having a sliding coating adhesively bonded thereto, said sliding coating comprising a copolymer (I) having 70% to 99% of structural building blocks derived from propylene monomers, based on the total number of the structural building blocks of the copolymer (I), and a remainder of structural building blocks derived from another olefin comprising ethylene or a $C_4$ to $C_{12}$ olefin, wherein the sliding coating is free of a copolymer having 50% or more of its structural building blocks derived from ethylene monomers, based on the total number of the structural building blocks of the copolymer.

2. The article of winter sports equipment according to claim 1, characterized in that the sliding coating, apart from the copolymer (I), is free of a copolymer containing structural building blocks derived from propylene.

3. The article of winter sports equipment according to claim 1, wherein said sliding coating comprises a mixture of a copolymer (I) and a copolymer (II), wherein the copolymer (I) and the copolymer (II) are copolymers of propylene and of at least one further olefin, and the copolymer (I) is as defined in claim 1, and wherein the bending strength of the copolymer (I) is at least by 50 MPa higher than the bending strength of the copolymer (II), the Vicat softening temperature of the copolymer (I) is by at least 5° C. higher than the Vicat softening temperature of the copolymer (II), and the Shore D hardness of the copolymer (I) is at least 5 units over the shore D hardness of the copolymer (II).

4. The article of winter sports equipment according to claim 3, characterized in that the copolymer (II) of said sliding coating is present in an amount from 5 to 50% by weight based on the total weight of copolymer (I) and copolymer (II).

5. The article of winter sports equipment according to claim 3, characterized in that the copolymer (II) of said sliding coating is a copolymer of propylene and a higher olefin with 4 to 10 carbon atoms or a terpolymer of propylene, ethylene and an olefin with 4 to 10 carbon atoms.

6. The article of winter sports equipment according to claim 5, characterized in that the olefin with 4 to 10 carbon atoms is octane.

7. The article of winter sports equipment according to claim 3, characterized in that the bending strength of the copolymer (I) of said sliding coating is at least 500 MPa higher than the bending strength of the copolymer (II), the Vicat softening temperature of the copolymer (I) is at least 50° C. higher than the Vicat softening temperature of the copolymer (II), and the Shore D hardness of the copolymer (I) is at least 20 units higher than the Shore D hardness of the copolymer (II).

8. The article of winter sports equipment according to claim 1, characterized in that the copolymer (I) of said sliding coating has a bending strength in the range of 200 MPa-3000 MPa, a Vicat softening temperature VST/A/50 in the range of 80° C. to 250° C. and a Shore D hardness in the range of 50 to 90, said sliding coating optionally comprising a copolymer (II) comprising a copolymer of propylene and at least one further olefin and having a bending strength in the range of 1 MPa to 500 MPa, a Vicat softening temperature VST/A/50 in the range of 1° C. to 80° C. and a Shore D hardness in the range of 1 to 50.

9. The article of winter sports equipment according to claim 8, characterized in that the copolymer (I) of said sliding coating has a bending strength in the range of 500 MPa to 3000 MPa.

10. The article of winter sports equipment according to claim 1, characterized in that the sliding coating further includes one or more lubricants.

11. The article of winter sports equipment according to claim 10, characterized in that the lubricant or the lubricants, respectively, is/are contained in an amount of 0.5 to 30% by weight based on the total weight of the copolymer (I) or the mixture of copolymer (I) and copolymer (II), respectively, if applicable.

12. The article of winter sports equipment according to claim 10, characterized in that the lubricant is selected from a high-temperature stabile primary or secondary fatty acid, a carboxylic acid ester and mixtures thereof.

13. The article of winter sports equipment according to claim 1, characterized in that the sliding coating further includes a nucleation agent.

14. The article of winter sports equipment according to claim 1, characterized in that the sliding coating additionally contains one or more further additives, selected from the group consisting of antistatic additives, additives for improving the hydrophobic properties, additives for improving the weather resistance, additives for improving the scratch resistance and pigments.

15. The article of winter sports equipment according to claim 14, characterized in that the sliding coating mixture contains a silicon compound and/or maleic anhydride.

16. The article of winter sports equipment according to claim 1, characterized in that the copolymer (I) of said sliding coating is a propylene/ethylene copolymer or an EPDM terpolymer.

17. The article of winter sports equipment according to claim 1, characterized in that the copolymer (I) of said sliding coating has a bending strength in the range of 800 to 2000 MPa, a Vicat softening temperature VST/A/50 in the range of 100° C. to 200° C. and a Shore D hardness in the range of 55 to 80, said sliding coating optionally comprising a copolymer (II) having a bending strength in the range of 10 MPa to 200 MPa, a Vicat softening temperature VST/A/50 in the range of 30° C. to 70° C. and a Shore D hardness in the range of 20 to 40.

18. The article of winter sports equipment according to claim 1, characterized in that said sliding coating has a surface structure, which has been applied before the melting point.

19. A method for producing an article of winter sports equipment according to claim 1, characterized in that a sliding coating mixture of copolymer (I), an optional copolymer (II) and optionally further ingredients is extruded to a film with a flat sheet extrusion method, onto which a surface structure is optionally subsequently applied before the melting point.

20. The winter sports equipment according to claim 1, characterized in that said article is a ski or a snowboard.

* * * * *